US008177070B2

(12) United States Patent
Minami

(10) Patent No.: US 8,177,070 B2
(45) Date of Patent: May 15, 2012

(54) AIR SIEVING METHOD AND APPARATUS

(75) Inventor: Isamu Minami, Tokyo (JP)

(73) Assignee: Seishin Enterprise Co., Ltd., Tokyo (JP)

( * ) Notice: Subject to any disclaimer, the term of this patent is extended or adjusted under 35 U.S.C. 154(b) by 14 days.

(21) Appl. No.: 12/865,893

(22) PCT Filed: Feb. 6, 2009

(86) PCT No.: PCT/JP2009/052081

§ 371 (c)(1),
(2), (4) Date: Aug. 3, 2010

(87) PCT Pub. No.: WO2009/099197

PCT Pub. Date: Aug. 13, 2009

(65) Prior Publication Data

US 2011/0000827 A1 Jan. 6, 2011

(30) Foreign Application Priority Data

Feb. 7, 2008 (JP) ..... 2008-027527

(51) Int. Cl.
*B07B 9/00* (2006.01)

(52) U.S. Cl. ..... 209/21; 209/139.1; 209/722

(58) Field of Classification Search ..... 209/21, 209/138, 139.1, 142, 149, 722
See application file for complete search history.

(56) References Cited

U.S. PATENT DOCUMENTS

| | | | | |
|---|---|---|---|---|
| 3,904,770 | A | 9/1975 | Hale et al. | |
| 4,038,049 | A * | 7/1977 | Melcher et al. | 95/62 |
| 4,526,678 | A * | 7/1985 | Myhren et al. | 209/2 |
| 5,224,604 | A * | 7/1993 | Duczmal et al. | 209/12.2 |
| 6,269,955 | B1 * | 8/2001 | Morimoto et al. | 209/723 |
| 7,104,403 | B1 * | 9/2006 | Stephens et al. | 209/20 |
| 7,119,298 | B2 | 10/2006 | Yoshiyama et al. | |
| 7,424,956 | B2 * | 9/2008 | Kohno | 209/721 |

FOREIGN PATENT DOCUMENTS

| | | | |
|---|---|---|---|
| JP | 53-041472 | A | 4/1978 |
| JP | 61-042380 | | 2/1986 |
| JP | 61-138516 | U | 8/1986 |
| JP | 61-238318 | A | 10/1986 |
| JP | 08-126848 | A | 5/1996 |
| JP | 2002-186908 | A | 7/2002 |
| JP | 2002/076620 | A1 | 10/2002 |
| JP | 2006-015298 | A | 1/2006 |
| JP | 2007-301490 | A | 11/2007 |
| WO | 2004/028711 | A1 | 4/2004 |

* cited by examiner

*Primary Examiner* — Joseph C Rodriguez
(74) *Attorney, Agent, or Firm* — Carrier Blackman & Associates, P.C.; William D. Blackman; Joseph P. Carrier

(57) ABSTRACT

An air sieving apparatus capable of sieving particles in a particle size range below 50 μm includes a cylindrical screening case defining an internal space and provided with a screen dividing the internal space into an upper space and a lower space. Powdered material is fed through a powdered material feed opening onto a bottom plate disposed to cover the lower open end of the screening case with gaps formed therebetween. Air in the screening case is sucked upward by a suction blower. The fed powdered material is dispersed by currents of air sucked through the gaps and the dispersed powdered material is sucked upward. Fine particles that have passed through the screen 3 flow through a fine particle recovery duct into a cyclone and a fine particle container. Coarse particles remaining in the lower space drop through the coarse particle recovery opening into a coarse particle container.

9 Claims, 9 Drawing Sheets

AIR SIEVING METHOD AND APPARATUS

TECHNICAL FIELD

The present invention relates to an air sieving method for sieving a powdered material by using air currents and an air sieving apparatus for carrying out the air sieving method.

BACKGROUND ART

There are three methods for classifying powdered material, which are a sieving method, a dry classifying (air-classifying) method and a wet classifying method. The present invention relates to sieving and air classification.

Air classification that classifies particles by the agency of balance of inertial force produced by air currents with gravity can classify small particles of particle sizes on the order of 1 μm by aptly using centrifugal force or the like. However, air classification is not satisfactory in classification accuracy because small particles classified by the air classification contain large particles and large particles classified by air classification contain small particles.

Classification using a screen, namely sieving, is satisfactory in sieving accuracy (classification accuracy). However, a screen of a smaller mesh size is liable to be clogged up. Therefore, the lower limit of a particle size range of small particles that can be screened by sieving is considerably large.

Various air sieving apparatus designed to prevent clogging of a screen have been proposed.

Basically, the air sieving apparatus is a sealed structure formed by covering a screening case excluding a powder feed opening with a lid. An internal space in the screening case is divided into upper and lower spaces by a screen. Usually, particles are fed onto the upper surface of the screen, the particles are dispersed by some means, and air is sucked downward through the screen to screen the dispersed particles by the screen.

In an air sieving apparatus disclosed in Patent Document 1, particles clogging the meshes of a screen is removed by ejecting a gas from a slotted nozzle that rotates along the lower surface of the screen to prevent the screen from being clogged up.

In an air sieving apparatus proposed by the inventors of the present invention in Patent Document 2, an upper end opening of a screening case is so covered with a lid that gaps are formed between the upper end surface of the screening case and the lid, and particles fed onto the upper surface of a screen are dispersed by air currents sucked through the gaps into an upper space in the screening case. Air currents and the particles entrained by the air currents flowing along the upper surface of the screen perform a screen cleaning effect of scraping particles caught in the meshes of the screen off the screen to prevent the screen from being clogged.

Although the sieving method described in Patent Documents 1 and 2 use air currents and classify particles by the screen, the same do not exercise the effect of air classification that uses the balance of inertial force produced by air currents with gravity.

A classifying apparatus disclosed in Patent Document 3 uses both screening and air classification.

The classifying apparatus disclosed in Patent Document 3 sprays powder into an ascending jet of air in a lower casing through a powder feed opening toward a classifying screen disposed above the powder feed opening. Fine particles that have passed through the classifying screen are collected in a space over the classifying screen and coarse particles are collected in a space under the classifying screen. The classifying apparatus is provided with a rotary air brush above the classifying screen, the air brush having slits through which high-pressure air is supplied to prevent the classifying screen from being clogged.

Patent Document 1: JP 2002-186908 A
Patent Document 2: JP 2007-301490 A
Patent Document 3: JP H8-126848 A

DISCLOSURE OF THE INVENTION

Problem to be Solved by the Invention

In the structure disclosed in Patent Document 1, particles plugged in the meshes of the screen are removed from the screen by ejecting a gas through the slotted nozzle. The synergetic effect of downward suction and gravity works on the particles, while the jet of the gas ejected through the slotted nozzle has only upward force. Therefore, meshes plugged with particles in a part of the screen exposed to the jet of the gas ejected through the rotating slotted nozzle are opened temporarily, but it is highly possible that those meshes are plugged again immediately after the slotted nozzle has passed by the same part of the screen. Therefore, it is difficult to process a large quantity of fine particles continuously and it is conjectured that the smallest practicable size of the meshes is on the order of 50 μm.

The structure disclosed in Patent Document 1 needs a complicated mechanism for ejecting the gas through the turning slotted nozzle and many component parts and is costly.

The structure disclosed in Patent Document 2 is a simple structure that sucks air through the gaps between the upper end surface of the screening case and the lid.

However, the synergetic effect of downward suction and gravity works on particles in the upper space as mentioned above and only locally generated turbulent air currents apply upward forces to particles. The air currents and particles entrained by the air currents flowing along the upper surface of the screen do not exercise a perfect screen cleaning effect of continuously sweeping away particles caught in meshes in every part of the screen. Further, the construction of the machine makes it difficult to continuously process a large quantity of powder for a long time.

The structure disclosed in Patent Document 3 utilizes both screening and air classification, in which upward suction and downward gravity act on particles and inertial forces produced by air currents and gravity cancel out each other. Thus, the clogging of the screen is reduced as compared with the clogging of the screens disclosed in Patent Documents 1 and 2. However the screen is clogged because the inertial force produced by air currents is considerably high. Although the clogged screen is unclogged by high-pressure air ejected through the rotary air brush, meshes of the screen, similarly to those of the screen of the structure disclosed in Patent Document 1, plugged with particles in a part of the screen exposed to the jet of high-pressure air ejected through the rotary airbrush are opened temporarily and, consequently, it is highly possible that those meshes are plugged again immediately after the rotary air brush has passed by the part of the screen. Therefore, continuously processing a large quantity of fine particles is difficult. Since the screen cleaning effect of air currents and particles entrained by the air currents like that of the structure disclosed in Patent Document 2 is unavailable. Therefore, it is conjectured that the practically possible lower limit size of the meshes is on the order of 50 μm.

The structure disclosed in Patent Document 3 needs the rotary air brush, a jet vessel (powder feed opening) for spraying powder into air currents toward the classifying screen and a feed pipe for feeding the material to the powder feed opening. Thus, the structure needs a number of parts and is complicated and costly.

The present invention has been made in view of those problems and it is therefore an object of the present invention to provide an air sieving apparatus capable of continuing a stable operation for a long time, having very simple construction, capable of being made at low cost, having the advantage of sieving technique excellent in classification accuracy and the advantage of sieving technique capable of classifying particles in a particle size range on the order of several micrometers, and capable of maintaining high classification accuracy to classify particles of particle sizes below 50 μm, and to provide an air sieving method to be carried out by the air sieving apparatus.

The inventors of the present invention examined the air sieving apparatus proposed by the inventors in Patent Document 2 and made studies for improvement of the air sieving apparatus to prevent the screen from being clogged up and to efficiently process a large quantity of fine particles. As a result, a dramatic effect not expected at all was found through experiments based on an original idea of inverting the sieving apparatus.

Experimental sieving using a fine screen having meshes of a mesh size not greater than 25 μm, such as 10 μm, which had been thought to be absolutely impossible to carry out by the conventional sieving apparatus, showed that the screen was conspicuously not clogged and proved that a large quantity of particles could be continuously classified.

Means for Solving the Problem

The present invention provides an air sieving method including the steps of: feeding a powdered material onto a bottom plate disposed to cover a lower open end of a cylindrical screening case defining an internal space divided into an upper space and a lower space by a screen with a gap formed between a lower end surface of the screening case and the bottom plate; generating ascending air currents in the screening case by suction produced by suction means; and screening the powdered material dispersed by currents of air that have flowed through the gap into the screening case and flowing along the bottom plate and caused to flow upward by suction with the screen.

The present invention provides an air sieving apparatus including: a cylindrical screening case defining an internal space and provided with a screen dividing the internal space into an upper space and a lower space; a bottom plate disposed to cover a lower open end of the cylindrical screening case with a gap formed between a lower end surface of the screening case and the bottom plate; a hopper having a material feed opening into the lower space of the screening case to feed a powdered material onto the bottom plate; and suction means for generating ascending air currents in the screening case.

In a first preferred mode of the present invention, the air sieving apparatus includes a fine particle recovering means disposed between the screen and the suction device to recover fine particles being sucked by the suction means; and a coarse particle container protruding downward from a coarse particle recovering opening formed in the bottom plate.

The air sieving apparatus in a further preferred mode of the present invention includes a lower case defining the lower space in the screening case and having the shape of a circular cylinder, an upper case defining the upper space in the screening case and having the shape of an upward tapered cone, the material feed opening is formed in one of the lower case and the bottom plate, and the coarse particle recovering opening formed in the bottom plate is on a center axis of the cylindrical lower case.

In the air sieving apparatus in a still further mode of the present invention, the screening case has the shape of a longitudinally elongate rectangular cylinder, the bottom plate has the shape of a longitudinally elongate rectangle, the bottom plate is disposed to cover the lower open end of the screening case with a gap formed between the bottom plate and the lower open end of the screening case, the upper open end of the screening case is covered with a top plate having the shape of a longitudinally elongate rectangle, the material feed opening is formed in one of a front wall of the longitudinally elongate lower case and a front end part of the bottom plate, the suction means sucks air in the screening case upward from a rear end part of the longitudinally elongate top plate, and the coarse particle recovering opening is formed in a rear end part of the longitudinally elongate bottom plate.

In the air sieving apparatus in another preferred mode of the present invention, the screening case and the bottom plate are declined rearward.

Effect of the Invention

The air sieving method of the present invention feeds a powdered material onto the bottom plate disposed opposite to the lower open end of the cylindrical screening case defining the internal space divided into the upper space and the lower space by the screen with the gap formed between the lower open end of the screening case and the bottom plate, and produces ascending air currents in the screening case by suction by the suction means. The powdered material fed onto the bottom plate is dispersed satisfactorily by the currents of air sucked through the gap into the screening case, and the dispersed powdered material is caused to pass upward through the screen by suction. Thus, the powdered material is sieved. Fine particles flow upward through the screen and coarse particles remain in the lower space.

Some coarse particles of the dispersed powdered material caused to flow upward by suction may be caught in the meshes of the screen. Upward suction and downward gravity act on the particles. Inertial force produced by air currents for air sieving and gravity cancel each other to diminish the probability of the meshes of the screen being plugged with particles. Even though particles are caught in the meshes of the screen, the particles are not firmly caught in the meshes.

Air sucked in through the gap along the bottom plate flows in swirling air currents along the lower surface of the screen in the lower space of the screening case. Swirling particles entrained by the swirling air currents have a screen cleaning effect that scrapes particles caught in the meshes of the screen off the screen. Since downward gravity acts always on particles caught in the meshes of the screen and pulls the particles off the screen and the particles are not firmly caught in the meshes, the particles are easily scraped off the screen to ensure high screen cleaning effect.

Thus, the screen is cleaned continuously to prevent clogging. Therefore, the air sieving apparatus can continue a stable operation for a long time and can maintain high sieving accuracy in sieving particles in a particle size range below 50 μm.

The air sieving method of the present invention can be carried out by a low-cost air sieving apparatus of very simple construction.

The air sieving apparatus of the present invention is an unprecedented one that feeds a powdered material onto the bottom plate placed under the screen dividing the internal space of the screening case into the upper and lower spaces and sucks air in the screening case upward. The powdered material fed through the material feed opening onto the bottom plate in the lower space is dispersed upward in the lower space by currents of air sucked through the gap extending along the bottom plate by suction produced by the suction means and the dispersed powdered material is caused to attempt passing upward through the screen by the upward suction. Thus, the powdered material is sieved. Fine particles pass through the screen into the upper space and coarse particles remain in the lower space.

The air sieving apparatus of the present invention is the same as the air sieving method in operation and effects. The air sieving apparatus has both the merit of sieving technique excellent in classification accuracy and the merit of air classification capable of classifying fine particles in a particle size range on the order of several micrometers. In this configuration of air sieving, inertial force produced by air currents and gravity cancel each other to diminish the probability of the meshes of the screen being plugged with particles, particles are not caught firmly in the meshes of the screen, and the screen cleaning effect of air currents swirling in the lower space in the screening case and the particles entrained by the swirling air currents prevents the screen continuously from being clogged up. Thus, the air sieving apparatus can continue a stable operation for a long time, can maintain high sieving accuracy and can achieve the sieving of particles in a particle size range below 50 μm.

The air sieving apparatus is simple in construction and can be made at low cost.

In a preferred mode of the present invention, the fine particle recovering means recovers fine particles being sucked by the suction means and the coarse particle container protrudes downward from the coarse particle recovering opening formed in the bottom plate. Therefore, coarse particles sieved and remaining in the lower space can be easily recovered through the coarse particle recovering opening in the coarse particle container and a continuous sieving operation can be achieved.

In a preferred mode of the present invention, the lower case has a cylindrical shape, the upper case has an upward tapered conical shape, the material feed opening is formed in the lower case or the bottom plate, and the coarse particle recovering opening is on the center axis of the cylindrical lower case. Therefore, a simple, small air sieving apparatus suitable for continuously sieving a small quantity of powdered material can be constructed.

In a preferred mode of the present invention, a material is fed onto the bottom plate through the material feed opening formed in the front wall of the lower case or in the front end part of the bottom plate, and air in the screening case is sucked upward through an opening formed in a rear end part of the top plate of the upper case. The powdered material in a front part of the lower space is dispersed upward and is caused to flow rearward by currents of air sucked through the gap extending along the bottom plate and upward suction causes the dispersed powdered material to flow toward the screen in an attempt to pass upward through the screen. Thus, the powdered material is sieved; fine particles pass through the screen, move rearward and are recovered by the fine particle recovering means, and coarse particles remaining in the lower space move rearward and are collected in the coarse particle container.

Since the screening case may be formed in a longitudinally elongate shape, a large air sieving apparatus can be built and a large quantity of powdered material can be continuously sieved.

In a preferred mode of the present invention, the screening case and the bottom plate are declined rearward. Consequently, the powdered material can be smoothly moved rearward and the powdered material can be efficiently sieved in a reduced processing time.

DESCRIPTION OF REFERENCE SIGNS

1 . . . Air sieving apparatus, 2 . . . Screening case, 3 . . . Screen, 4 . . . Lower space, 5 . . . Upper space, 6 . . . Fine particle recovery duct, 7 . . . Suction blower, 8 . . . Cyclone, 9 . . . Fine particle container, 10 . . . Bottom plate, 11 . . . Spacer, 12 . . . Gap, 15 . . . Material feed opening, 16 . . . Hopper, 17 . . . Material feeder, 20 . . . Coarse particle recovery opening, 21 . . . Coarse particle container, 25 . . . Hammering device, 50 . . . Air sieving apparatus, 52 . . . Screening case, 53 . . . Screen, 54 . . . Lower space, 55 . . . Upper space, 56 . . . Top plate, 57 . . . Fine particle recovery opening, 60 . . . Suction blower, 60 . . . Bottom plate, 61 . . . Spacer, 62 . . . Gap, 65 . . . Material feed opening, 66 . . . Hopper, 67 . . . Material feeder, 70 . . . Coarse particle recovery opening, 71 . . . Coarse particle container, 75 . . . Hammering device, 80 . . . Support

BEST MODE FOR CARRYING OUT THE INVENTION

Figure 1:
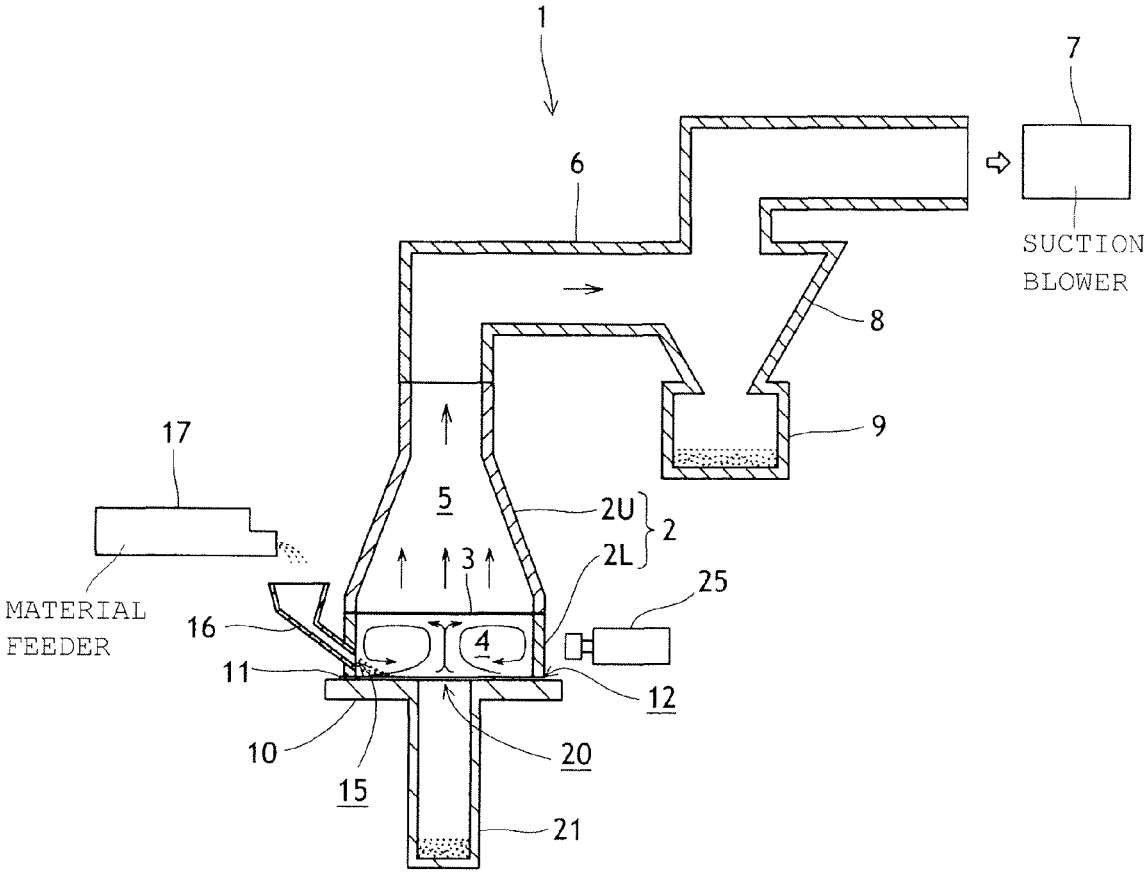
FIG. 1 is a schematic view showing the construction of an air sieving apparatus in a first embodiment of the present invention.
Figure 2:
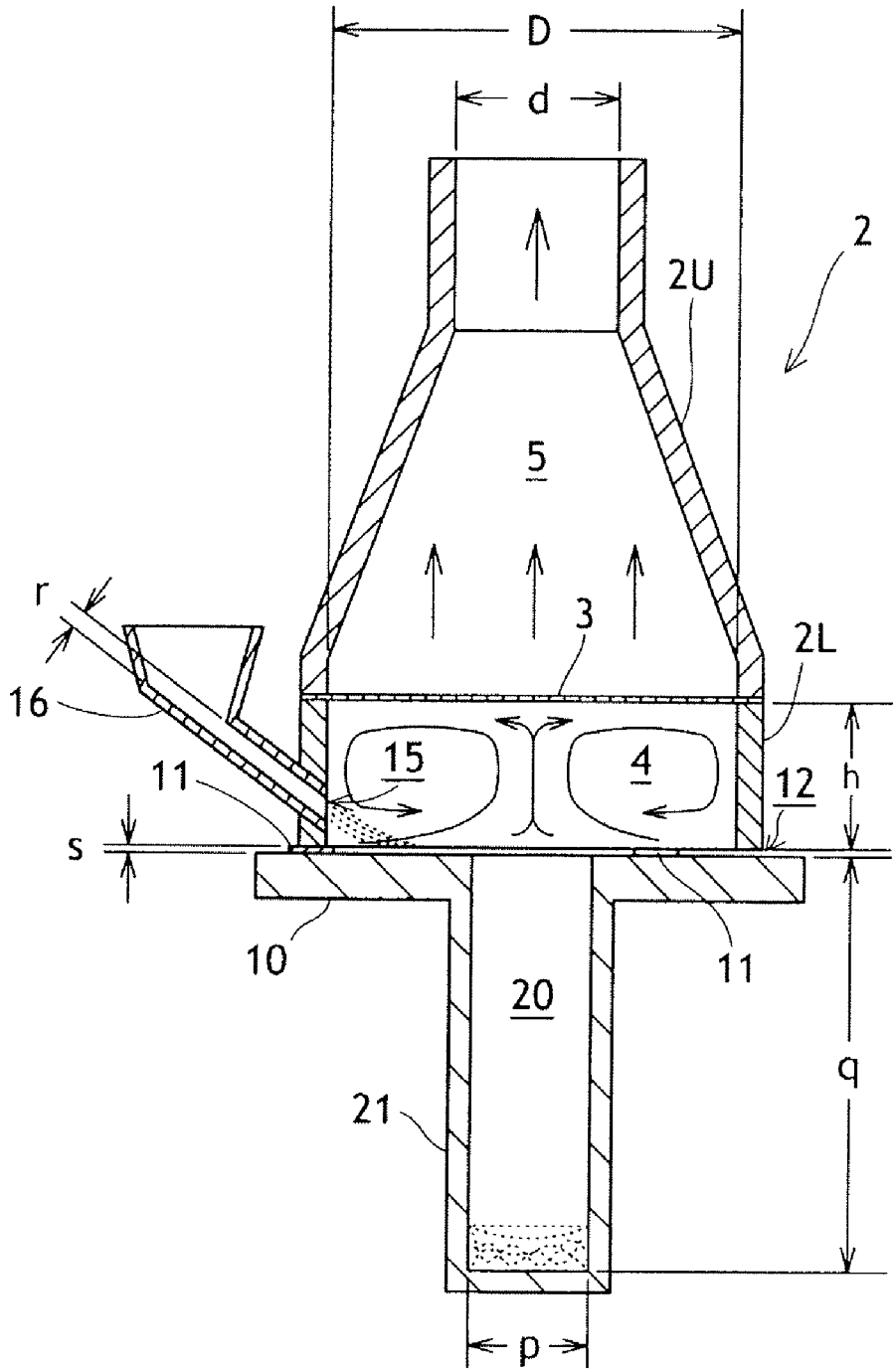
FIG. 2 is a sectional view of a main unit of the air sieving apparatus.
Figure 3:
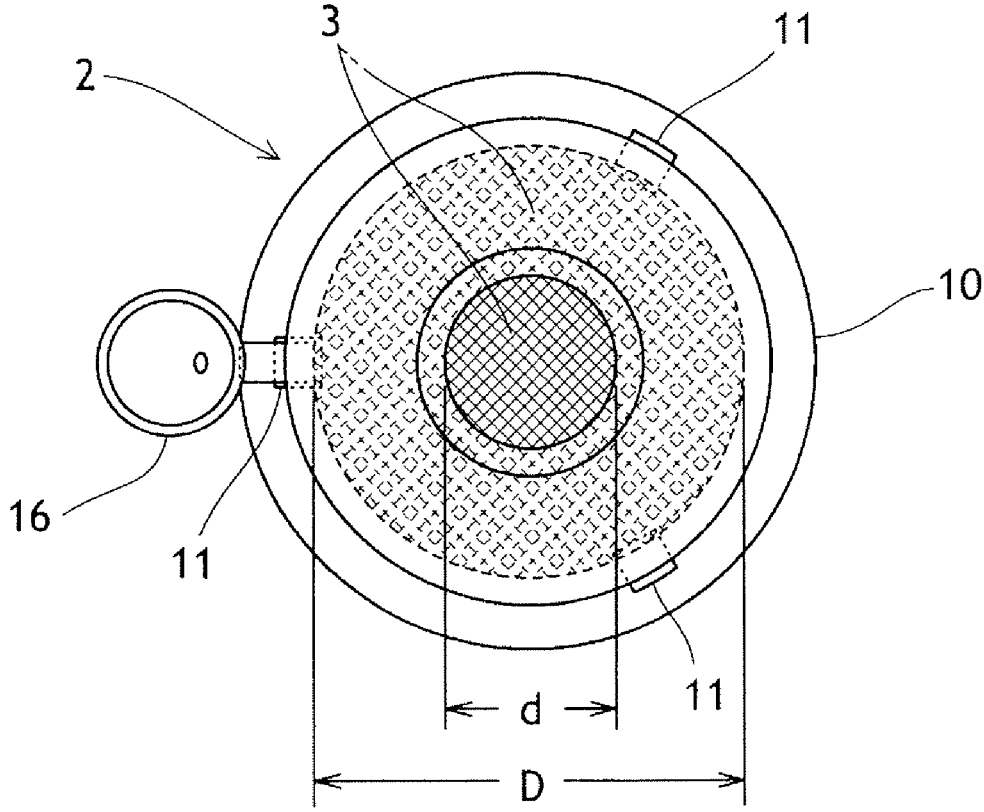
FIG. 3 is a top view of the main unit of the air sieving apparatus.

A first embodiment of the present invention will be described with reference to FIGS. 1 to 8. FIGS. 1 to 3 show the construction of an air sieving apparatus 1 in a first embodiment of the invention.

The air sieving apparatus has a circular cylindrical screening case 2 with an internal space of about 75 mm in inside diameter, which is divided into a lower space 4 and an upper space 5 by a screen 3.

The screen 3 may be made of a metal or resin woven net or a metal or resin microsieve.

The inside diameter of the screening case 2 is not limited to 75 mm, and a screening case having a different inside diameter can be used as the screening case 2.

An upper case 2U defining the upper space 5 of the screening case 2, excluding a lower part thereof, has the shape of an upwardly tapered circular cone. A fine particle recovery duct 6 is connected to the upper case 2U. A suction blower 7 is connected to a downstream end of the fine particle recovery duct 6.

The shape of the upper case does not necessarily need to be the shape of a circular cone.

A cyclone (or a bag filter or the like) 8 is placed in the fine particle recovery duct 6 and a fine particle container 9 is disposed below the cyclone 8.

A lower case 2L defining the lower space 4 and forming a part of the screening case 2 has the shape of a flat circular cylinder. A circular bottom plate 10 is disposed opposite to the lower open end of the lower case 2L, namely, the lower open end of the screening case 2, with predetermined gaps formed between the bottom plate 10 and the lower open end of the lower case 2L.

Three spacers 11 of a predetermined thickness are arranged at equal intervals and attached to three parts of an annular portion of the upper surface of the bottom plate 10 facing the lower end surface of the screening case 2 to form the gaps 12 of a predetermined thickness between the lower end surface of the screening case 2 and the bottom plate 10.

The thickness s or height of the gaps 12 is equal to the thickness of the spacers 11. The number of the spacers 11 is not limited to three.

Although the gaps 12 are formed by placing the spacers 11 between the lower end surface of the screening case 2 and the circular bottom plate 10 in this embodiment, gaps may be formed along the upper surface of the bottom plate by cutting holes of a predetermined height or depth in a circumferential arrangement in the lower end surface of the screening case 2 and joining the bottom plate to the lower end surface of the screening case 2 instead of using the spacers.

Alternatively, the screening case 2 may be formed in the shape of a bottomed case having an integral bottom wall, and slits (apertures) of a predetermined height may be formed in a circumferential arrangement in the circumferential wall along the bottom wall.

The shape of the gaps does not necessarily need to be a quadrilateral shape and may be a polygonal shape other than quadrilateral shape, a circular shape or an elliptical shape.

Although it is preferable, from the viewpoint of effectively dispersing powdered material and effectively cleaning the screen by swirling air currents, that the gaps are contiguous with the bottom plate 10, the gaps may be slightly separated upward from the bottom plate 10.

It is important that currents of air sucked through the gaps by suction means flow in a plane parallel or substantially parallel to the bottom plate. There are no restrictions on the shape of the gaps and how the gaps are formed, provided that such air currents can be produced.

A material feed opening 15 is formed in a part of the side wall of the lower case 2L defining the lower space 4. A discharge end part of a hopper 16 is inserted in the material feed opening 15. A material feeder 17 feeds a material into the hopper 16.

The material feeder 17 may be a continuous feeder, such as a vibration feeder, a table feeder or a screw feeder.

The material feed opening 15 opening into the lower space 4 is formed adjacent to the lower open end of the lower case 2L. The material fed into the hopper 16 is discharged through the material feed opening 15 directly onto the bottom plate 10 in the lower space 4.

A coarse particle recovery opening 20 is formed in a central part of the circular bottom plate 10 (the center of the lower space 4). A coarse particle container 21 extends downward from the coarse particle recovery opening 20. The coarse particle container 21 is of a sealed structure having a bottom.

The coarse particle container 21 may be provided with a suitable opening in its side wall or the like instead of being formed in a sealed structure to produce ascending air currents flowing upward into the coarse particle recovery opening for obstructing entry of fine particles into the coarse particle container 21.

To continue the operation for a long time, each of the coarse particle container 21 and the fine particle container 9 may be a sealed structure provided with means for intermittently or continuously discharging particles collected therein to the outside. The means may be a known rotary valve, a known double damper or the like.

The continuous air sieving apparatus 1 has a simple construction as described above. The suction blower 7 is operated to suck air upward in the screening case 2 through the fine particle recovery duct 6 while the material feeder 17 feeds the material continuously into the hopper 16 to deliver the material onto the bottom plate 10 in the lower space 4 to achieve continuous screening.

When air in the screening case 2 is sucked upward by the suction blower 7, air is sucked into the lower space 4 through the gaps 12 formed between the lower end surface of the screening case 2 and the bottom plate 10.

Air sucked through the gaps 12 into the lower space 4 flows along the upper surface of the bottom plate 10 in the lower case 4. It is conjectured that air flows in swirling air currents as shown in FIG. 1 in the lower case 4. Air flows from the circumference of the lower space 4 toward the center of the lower space 4 in a lower area of the lower space 4, the air changes its flowing direction gradually as it approaches the center of the lower space 4 and starts to flow upward toward the lower surface of the screen 3, the air is diffused so as to flow along the lower surface of the screen 3 in radially outward directions, the air starts to flow downward as it approaches the inside surface of the lower case 2, and then the air merges into the air flowing from the circumference of the lower space 4 toward the center of the lower space 4 along the upper surface of the bottom plate 10.

Therefore, the material is continuously fed by the material feeder 17 onto the bottom plate 10 in the lower space 4 through the material feed opening 15 formed in the lower case 2L. The material is then entrained by the swirling air currents and carried toward the central area in the lower space 4 and upward from a lower, central area, and thereafter the material is dispersed radially outward along the lower surface of the screen 3 in an upper area of the lower space 4. Thus, the material is dispersed over the entire lower surface of the screen 3. The material dispersed over the entire surface of the screen 3 by air sucked upward through the screen 3 by the suction blower 7 is sieved efficiently by the screen 3. Fine particles that have passed through the screen 3 flow through the fine particle recovery duct 6, are collected by the cyclone 8 and are collected in the fine particle container 9.

The residual powdered material remaining in the lower space 4 after recovering fine particles by screening is a mixture of coarse particles and unrecovered fine particles. The residual powdered material is dispersed radially along the lower surface of the screen 3, starts to flow downward as the residual powdered material approaches the sidewall of the lower case 2L, and merges into air flowing from the circumference of the bottom plate 10 toward the center of the same along the upper surface of the bottom plate 10. When the residual powdered material moves past the coarse particle recovery opening 20 in the central part of the bottom plate 10, large, coarse particles respectively having large masses are caused to drop through the coarse particle recovery opening 20 by gravity. Fine particles contained in the residual powdered material are entrained by swirling air currents so as to flow upward. Thus, coarse particles are classified naturally.

Coarse particles that have dropped through the coarse particle recovery opening 20 are collected in the coarse particle container 21.

Fine particles contained in the continuously fed powdered material are sieved from the powdered material by the screen 3 and coarse particles drop through the coarse particle recovery opening 20 while the powdered material is flowing together with the swirling air currents. Fine particles that have passed upward through the screen 3 flow through the upper case 2U and the fine particle recovery duct 6, are collected by the cyclone 8 and are stored in the fine particle container 9. Coarse particles remaining in the lower space 4 drop through the coarse particle recovery opening 20 and are accumulated gradually in the coarse particle container 21.

Thus, fine particles are sieved from the powdered material efficiently and are recovered by a perfectly continuous operation.

The continuous air sieving apparatus 1 has a very simple construction. The fed material is dispersed satisfactorily in the lower space 4 and is not concentrated on a part of the screen 3. Since all the parts of the screen 3 are used for screening the material, the screen will not be easily clogged up.

In the continuous air sieving apparatus 1, upward suction and downward gravity act on particles and inertial forces produced by air currents and gravity cancel out each other. Thus, the clogging of the screen is reduced. Even though particles are caught in the meshes of the screen 3, the particles are not firmly caught in the meshes.

As mentioned above, air currents flowing through the gaps 12 extending along the bottom plate 10 into the lower space 4 flow in swirling air currents in the lower space 4 and diffuse radially from the central part of the screen 3 along the lower surface of the screen 3. The swirling air currents and the flow of particles entrained by the swirling air currents exercise a screen cleaning effect of scraping particles caught in the meshes of the screen off the screen. Since downward gravity effective in removing particles from the meshes acts continuously on particles and particles are not firmly caught in the meshes, particles can be easily scraped off the screen to achieve a high screen cleaning effect.

Although the air sieving apparatus 1 is very simple in construction, the screen 3 is effectively cleaned at all times and the clogging of the screen is substantially perfectly prevented. Therefore, the air sieving apparatus 1 can operate stably for a longtime and can maintain high sieving accuracy in sieving fine particles in a fine particle size range below 50 μm.

The screening case 2 may be tapped by a hammering device 25 as the need arises to continue a stable operation for a long time. When the screening case 2 is thus tapped, particles caught in the meshes become easily removable, the clogging of the meshes can be more effectively prevented, sieving accuracy can be still more improved, sieving speed is enhanced and work time can be reduced.

A known device, other than the hammering device, for preventing the clogging of the screen, such as a vibrator or an ultrasonic device, may also be used.

Experiment 1 was conducted by using the continuous air sieving apparatus 1. Experimental results will be described.

Referring to FIGS. 2 and 3, the continuous air sieving apparatus 1 was provided with a screening case 2 having a lower case 2L of a height h of 30 mm and an inside diameter D of 75 mm having the shape of a flat circular cylinder, and an upper case 2U having the shape of a flask and having a minimum upper end part of a diameter d of 30 mm.

Although dependent on properties of the powdered material and classification conditions, a preferable value of the height h of the lower case 2L is about 10 mm or above.

The thickness s of the gaps 12, namely, the distance between the lower end surface of the screening case 2 and the bottom plate 10, is 0.5 mm.

Desirably, the thickness s of the gaps 12 is in the range of 0.1 to 5.0 mm, more desirably, in the range of 0.5 to 2.0 mm.

The diameter p of the coarse particle recovery opening 20 formed in the central part of the bottom plate 10 is 25 mm and the depth q of the coarse particle container 21 is 80 mm.

The diameter r of the material feed opening 15 formed in the lower case 2L is 5 mm.

A maximum value of the diameter of the material feed opening 15 is about 10 mm. A material feed opening of a diameter greater than 10 mm affects the swirling currents.

A material designated as "DUST Class 2" in JIS (JAPAN INDUSTRIAL STANDARDS) as a test material was fed by the material feeder 17 at a feed rate of 100 g/h.

Test operation used a very fine screen of 25 μm in mesh size as the screen 3 and operated the suction blower 7 at a suction force of −0.8 kPa on the upper surface of the screen 3 and at a suction rate of 0.22 $m^3$/min.

A desirable suction force is in the range of 0.2 to 1.2 kPa and a desirable suction rate is in the range of 0.1 to 0.4 $m^3$/min.

Figure 4:
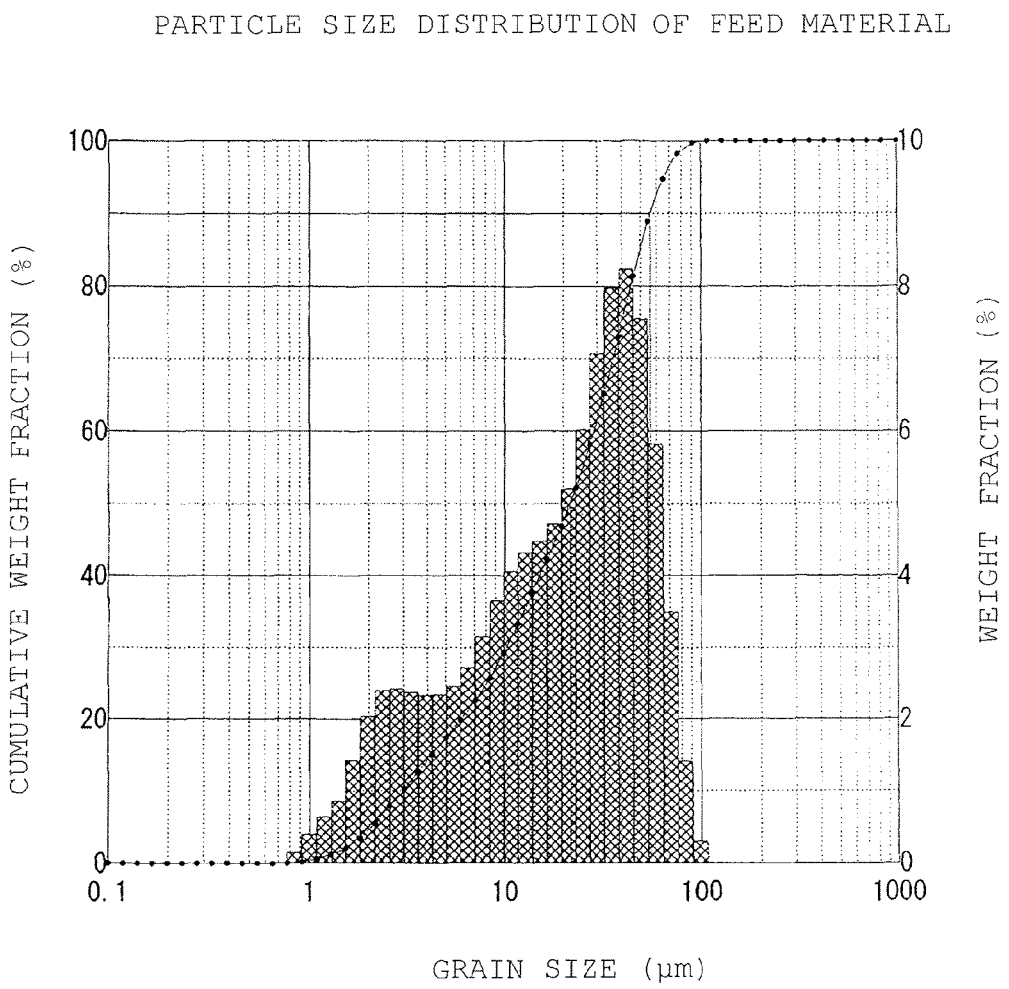
FIG. 4 is a graph showing a particle size distribution of a feed material.

Conditions for Experiment 1
Sample: DUST Class 2
Mesh size of the screen: 25 μm
Thickness s of the gaps: 0.5 mm
Suction force (Gage pressure): −0.8 kPa
Suction rate: 0.22 $m^3$/min A particle size distribution in the feed powdered material was determined by measurement using a laser diffraction scattering particle size distribution measuring apparatus Type LMS-300 provided by Seishin Enterprise Co., Ltd. A measured particle size distribution is shown in FIG. 4.

The particles of the feed material had irregular shapes. Particle sizes of the particles of the feed material were distributed in the range of about 1.0 to 108 μm. The particle size distribution curve had a maximum fraction at particle sizes around about 46 μm.

Figure 5:
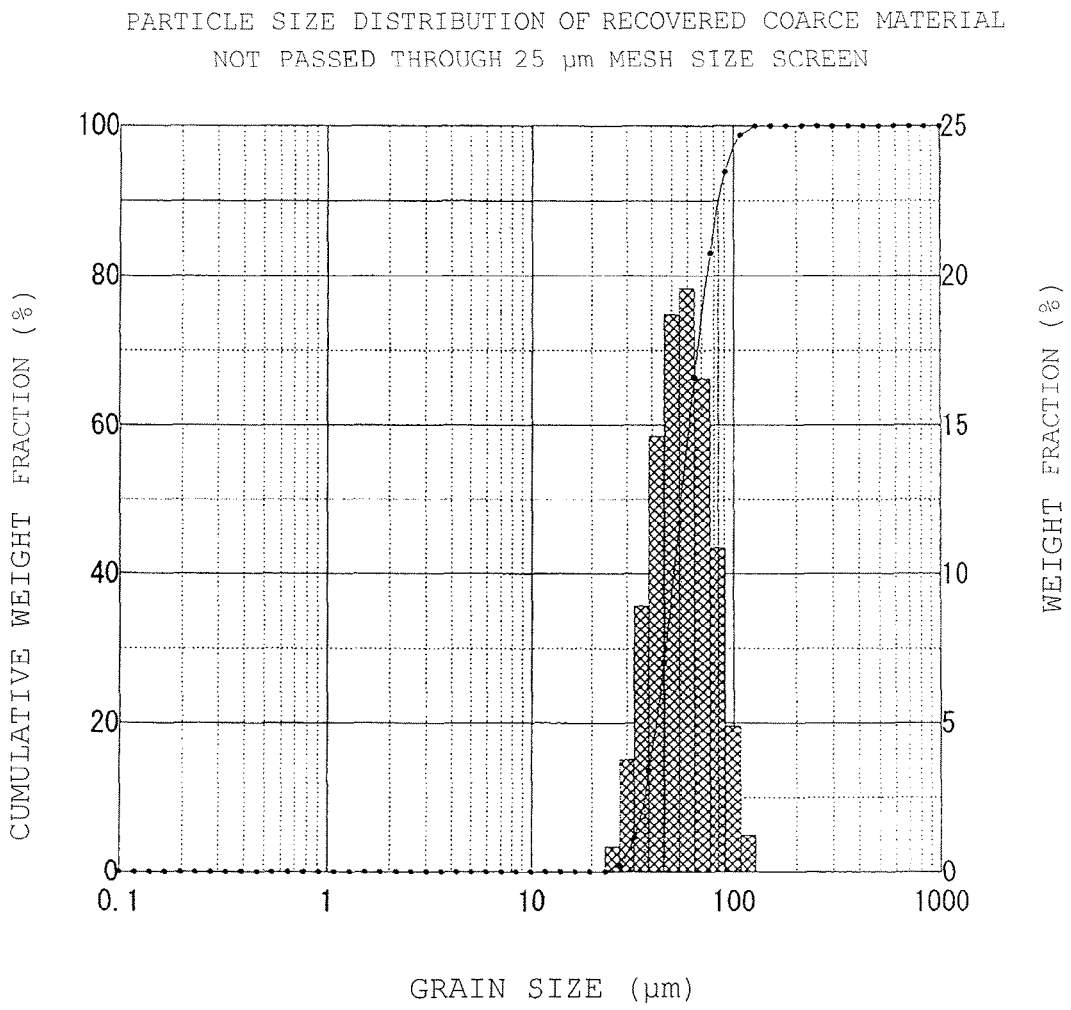
FIG. 5 is a graph showing a particle size distribution of screen-unpassed material obtained in Experiment 1.

Measurements were made of the particle size distribution of coarse particles not passed through the screen 3 having the mesh size of 25 μm and collected in the coarse particle container 21 and the particle size distribution of fine particles passed through the screen 3 and collected in the fine particle container 9 after continuously operating the air sieving apparatus for 30 min. Measured results are shown in FIGS. 5 and 6.

The screen 3 was scarcely clogged and remained in a clean state after the continuous operation.

Figure 6:
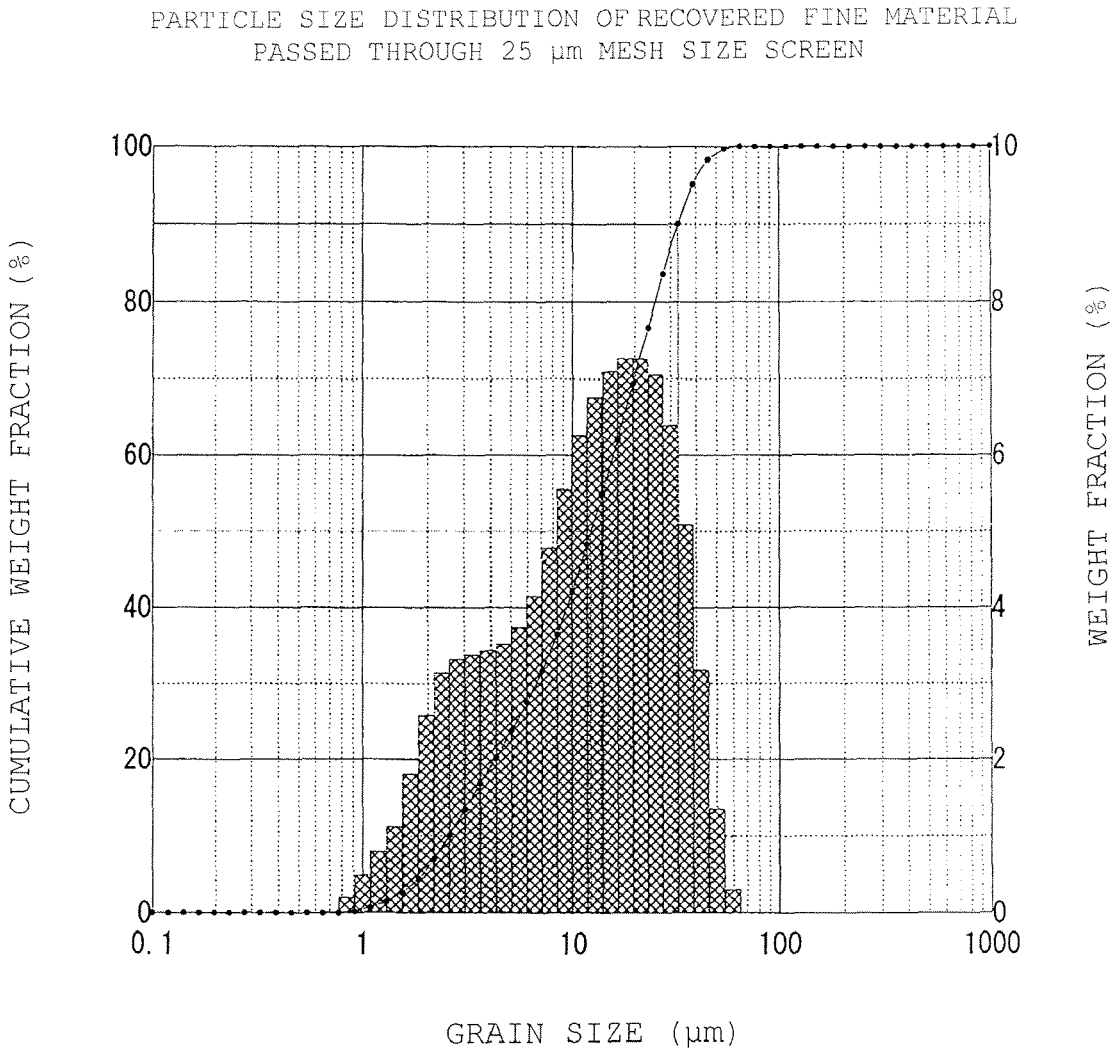
FIG. 6 is a graph showing a particle size distribution of screen-passed material obtained in Experiment 1.

Referring to FIG. 6 showing a particle size distribution of fine particles passed through the screen 3 and collected in the fine particle container 21, the proportion of the cumulative weight fraction of particles not greater than 25 μm is on the order of 80%. Referring to FIG. 5 showing a particle size distribution of coarse particles not passed through the screen 3 and collected in the coarse particle container 21, the cumulative weight proportion of particles not greater than 25 μm is on the order of 0.3%. It is known from FIGS. 5 and 6 that the powdered material could be satisfactorily sieved in high sieving accuracy into fine particles smaller than 25 μm and coarse particles not smaller than 25 μm.

It has been very difficult for conventional sieving apparatus to sieve very fine particles of particle sizes not greater than 50 μm, such as 25 μm. The air sieving apparatus 1 of the present invention achieved sieving in such satisfactorily high accuracy that the cumulative weight fraction of particles of particle sizes not greater than 25 μm was on the order of 80%.

Cumulative weight fraction of particles of particle sizes not smaller than 25 μm passed through the screen 3 and collected in the fine particle container was about 20%. Such screening occurred because the particles of the feed powdered material had irregular shapes, slender particles passed through the screen 3 and some particles of particle sizes below 25 μm were measured to be those of particle sizes not smaller than 25 μm owing to the characteristic of the laser diffraction scattering particle size distribution measuring apparatus.

Although the screen 3 having fine meshes of a small mesh size of 25 μm was used for screening fine particles, the powdered material was satisfactorily dispersed in the lower space 4, particles were diffused over the entire lower surface of the screen 3, particles were attracted to the entire lower surface of the screen 3, the screen 3 was not easily clogged because inertial forces produced by air currents and gravity cancel out each other and sieving accuracy was improved.

Although gravity acting on particles canceled out the suction force that generates ascending air currents, the suction force of −0.8 kPa considerably lower than that used for conventional classification avoided clogging of the screen with large particles which tend to be firmly caught in the meshes by a high suction force.

Experiment 2 will be described which was conducted by using the air sieving apparatus 1, which was the same in construction as the air sieving apparatus used in Experiment 1, except for use of a screen having a mesh size of 10 μm.

Conditions for Experiment 2

Sample: DUST Class 2

Mesh size of the screen: 10 μm

Thickness s of the gaps: 0.5 mm

Suction force (Gage pressure): −0.6 kPa

Suction rate: 0.18 $m^3$/min

The same material "DUST Class 2" as that used for Experiment 1 was used. The material had a particle size distribution shown in FIG. 4.

Figure 7:
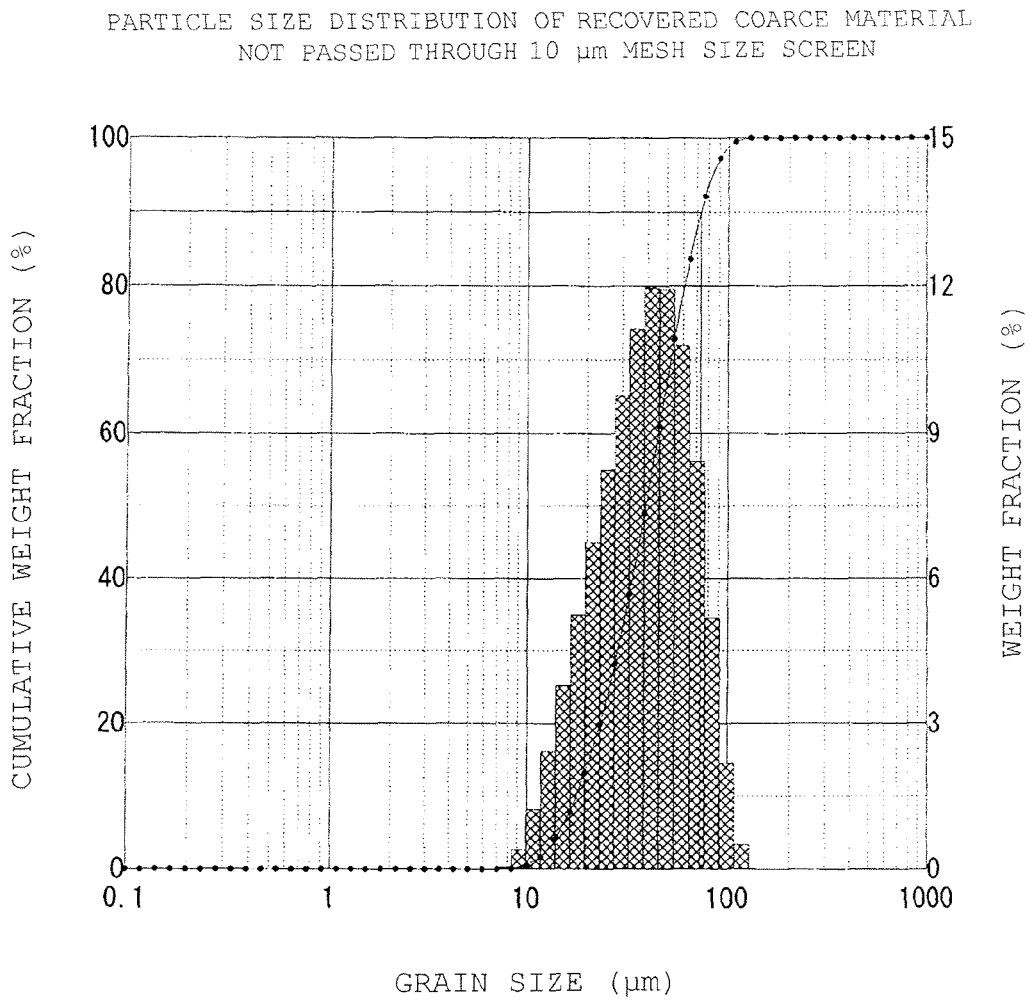
FIG. 7 is a graph showing a particle size distribution of screen-unpassed material obtained in Experiment 2.

Measurements were made of the particle size distribution of coarse particles not passed through the screen 3 having the mesh size of 10 μm and was collected in the coarse particle container 21 and the particle size distribution of fine particles passed through the screen 3 and collected in the fine particle container 9 after continuously operating the air sieving apparatus for 30 min. Measured results are shown in FIGS. 7 and 8.

The screen 3 was scarcely clogged and remained in a clean state after the continuous operation.

Figure 8:
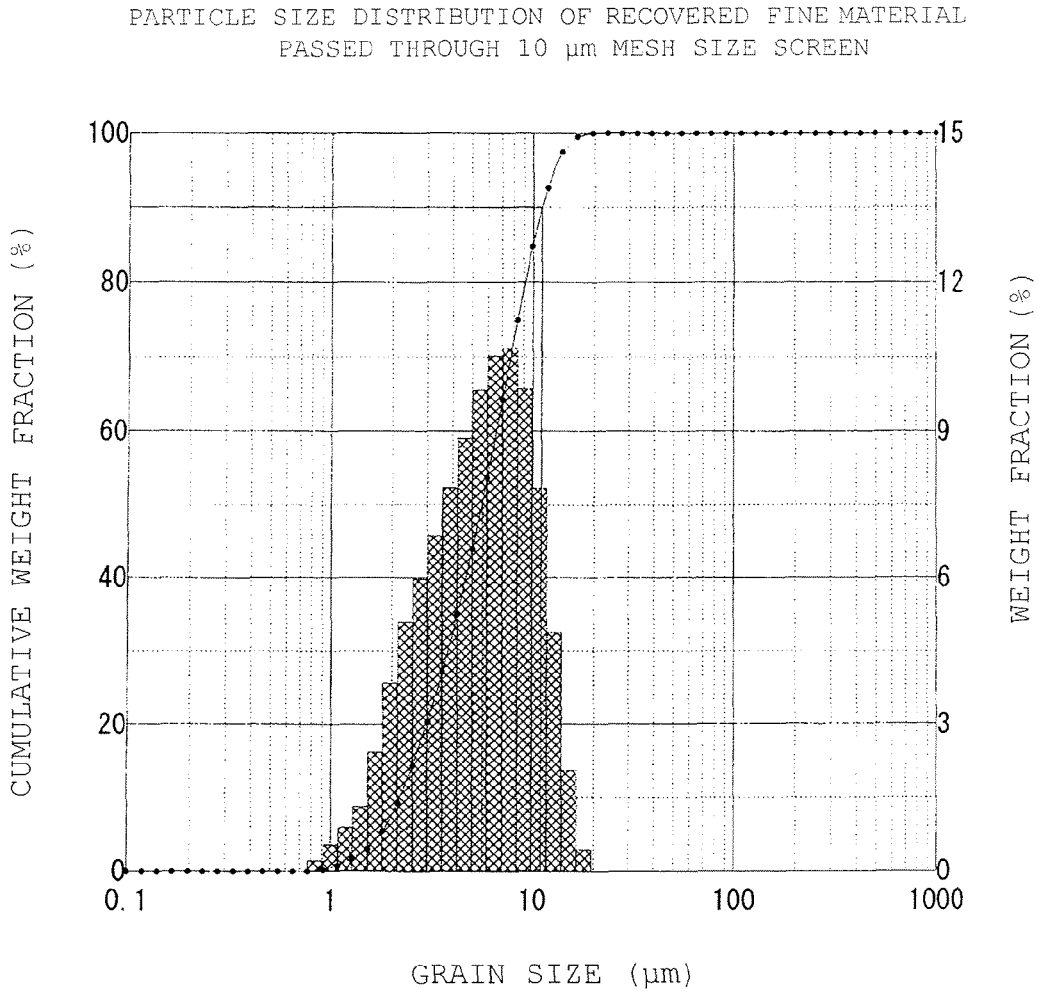
FIG. 8 is a graph showing a particle size distribution of screen-passed material obtained in Experiment 2.

Referring to FIG. 8 showing a particle size distribution of fine particles passed through the screen 3 and collected in the fine particle container 21, the cumulative weight fraction of particles having particle sizes not greater than 10 μm was on the order of 85%. Referring to FIG. 7 showing a particle size distribution of coarse particles not passed through the screen 3 and collected in the coarse particle container 21, the cumulative weight fraction of particles having particle sizes not greater than 10 μm was on the order of 0.5%. It is known from FIGS. 7 and 8 that the powdered material could be satisfactorily sieved in high sieving accuracy into fine particles of particle sizes smaller than 10 μm and those of particle sizes not smaller than 10 μm.

It has been considered that the classification of fine particles of particle sizes in a fine particle size range of 10 μm by the conventional sieving apparatus is impossible. The air sieving apparatus 1 of the present invention achieved the sieving of fine particles of particle sizes in such a fine particle size range in high sieving accuracy despite its very simple construction.

There is no upper limit to the mesh size of a screen applicable to the continuous air sieving apparatus of the present invention. However, it will not be energy-efficient to let excessively large particles pass the screen upward in view of relation to balancing the upward inertial force produced by air currents with downward gravity. From a practical point of view, it is considered that an upper limit to the mesh size of the screen is on the order of 50 μm, preferably, 40 μm or below, most desirably, 30 μm or below.

Although there is no lower limit to the mesh size of the screen, it is considered that a lower limit mesh size is substantially 1 μm or above owing to limited available techniques relating to screens, preferably, 3 μm or above.

The material feed opening 15 through which a powdered material is fed into the lower space 4 is formed in the lower case 2L of the screening case 2. However, even if a material feed opening is formed in the bottom plate 10 and powdered material is fed through that material feed opening, the powdered material can also be sucked and fed onto the bottom plate 10 by negative pressure because air currents flow along the upper surface of the bottom plate 10.

The currents of air to be sucked through the gaps 12 between the lower end surface of the screening case 2 and the bottom plate 10 into the lower space 4 may be filtered beforehand with an air filter or the like to prevent sucking foreign fine particles and foreign matters into the lower space 4.

Figure 9:
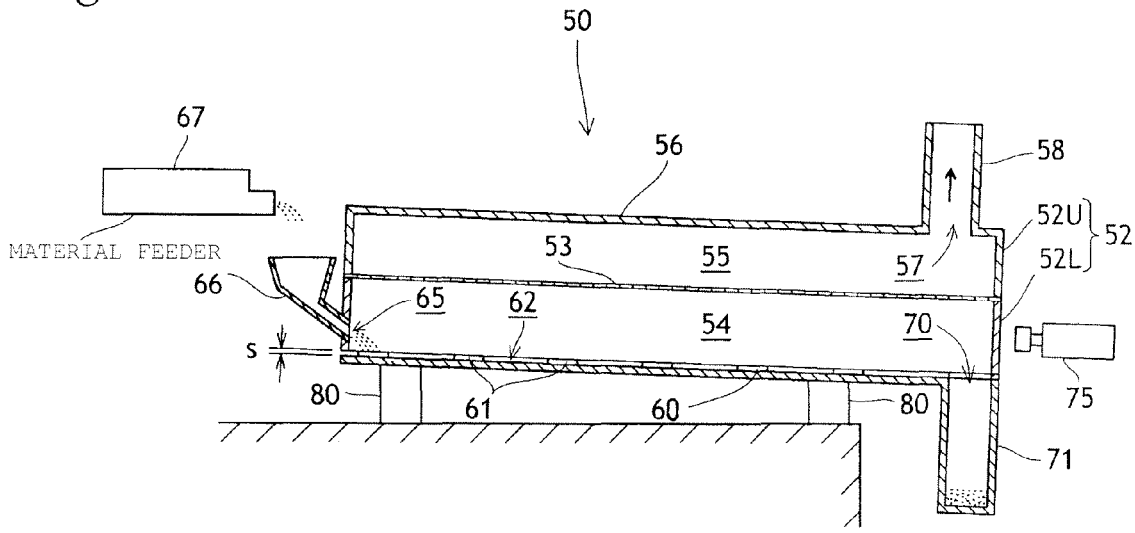
FIG. 9 is a longitudinal sectional view of an air sieving apparatus in a second embodiment of the present invention.
Figure 10:
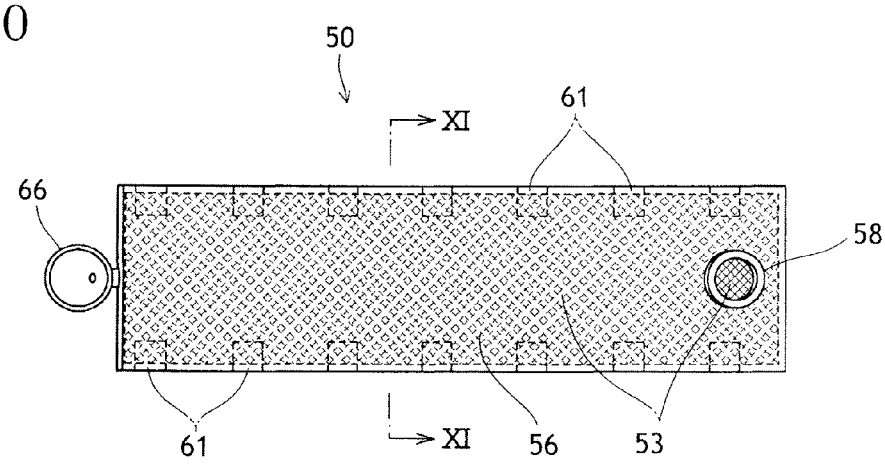
FIG. 10 is a top view of a main unit of the air sieving apparatus shown in FIG. 9.

An air sieving apparatus 50 in a second embodiment of the present invention will be described with reference to FIGS. 9 to 11.

The air sieving apparatus 50 has a screening case 52 having the shape of a longitudinally elongate rectangular cylinder. The interior of the screening case 52 is divided into a lower space 54 and an upper space 55 by a screen 53.

An upper case 52U defining the upper space 55 of the screening case 52 has the shape of a longitudinally elongate, flat, rectangular box. A longitudinally elongate top plate 56 is attached to the upper open end of the upper case 52U to close the upper space 55. A fine particle recovery opening 57 is formed in a rear part of the top plate 56. A fine particle recovery duct 58 is connected to the fine particle recovery opening 57.

A suction blower, not shown, is connected to the downstream end of the fine particle recovery duct 58. A cyclone is placed in the fine particle recovery duct 58 and a fine particle container is disposed below the cyclone as shown in FIG. 1.

A lower case 52L defining the lower space 54 of the screening case 52 is a rectangular box of the same shape as the upper case 52U. The lower open end, namely, the lower open end of the screening case 52, is covered with a longitudinally elongate, rectangular bottom plate 60 such that gaps of a predetermined thickness are formed between the lower end surface of the lower case 52L and the bottom plate 60.

Spacers 61 of a predetermined thickness arranged at equal intervals are attached to parts of a rectangular portion of the upper surface of the bottom plate 60 facing the lower end surface of the lower case 52L. When lower open end of the screening case 52 is covered with the bottom plate 60, the spacers 61 define gaps 62 of a predetermined thickness between the lower end surface of the screening case 52 and the rectangular bottom plate 60.

All the spacers 61 may have the same thickness. The spacers 61 in a front part of the air sieving apparatus and those in a rear part of the air sieving apparatus may have different thicknesses, respectively, to adjust the flow and velocity of air that flows through the gaps.

There are no particular restrictions on the shape and how the gaps are formed, provided that air sucked through the gaps by the suction blower flows in air currents that flow in a plane substantially parallel to the bottom plate.

A material feed opening 65 is formed in the front wall of the lower case 52L defining the lower space 54. A discharge end part of a hopper 66 is inserted in the material feed opening 65. A feeder 67 feeds the material to the hopper 66.

The material feed opening 65 is formed adjacent to the lower open end surface of the lower case 52L. The material loaded into the hopper 66 is fed through the material feed opening 65 directly onto an upstream end part, namely, a front end part, of the bottom plate 60 of the lower space 54.

A coarse particle recovery opening 70 is formed in a rear part of the longitudinally elongate, rectangular bottom plate 60 covering the lower open end of the lower case 52L. A coarse particle container 71 extends downward from the coarse particle recovery opening 70. The coarse particle container 71 is a sealed structure having a bottom.

To enable a long, continuous operation, the coarse particle container 71 and the fine particle container, not shown, formed in sealed structures may be provided with particle discharge means capable of intermittently or continuously discharging the particles collected therein to the outside, respectively. Possible particle discharge means are rotary valves, double dampers and the like.

Hammering devices 75 are arranged around the screening case 52.

A main unit of the air sieving apparatus 50 is supported on supports 80 so as to decline rearward.

Although dependent on properties of the powdered material, it is preferable that the inclination of the bottom plate 60 with respect to a horizontal plane is 30° or below, more desirably, 15° or below.

The inclination of the bottom plate 60 may be 0°, i.e., the bottom plate 60 may be horizontal. If circumstances need, the bottom plate 60 may be inclined such that the rear part thereof is slightly higher than front parts thereof.

As described above, the air sieving apparatus 50 has a simple construction. The material feeder 67 feeds the material continuously into the hopper 66 to discharge the material onto the bottom plate 60 in the lower space 54 while air in the screening case 52 is sucked upward through the fine particle recovering duct 58 by the suction blower to perform a continuous sieving operation.

When the suction blower is operated to suck air in the screening case 52 upward, air is sucked through the gaps 62 formed between the lower end surface of the screening case 52 and the bottom plate 60 at positions in the periphery of the lower space 54 into the lower space 54 and flows along the upper surface of the bottom plate 60. Then, the material discharged through the material feed opening 65 onto an upstream part of the bottom plate 60 is dispersed upward in a front area of the lower space 54. While the dispersed material is moving rearward, the material is caused to tend to pass the screen 53 upward by the upward suction force. Thus, the material is sieved. Fine particles pass through the screen 5, move rearward, are sucked upward through the fine particle recovery opening 57, are recovered by the fine particle recovering means. Coarse particles remaining in the lower space 54 move smoothly rearward along the inclined bottom plate 60, drop through the coarse particle recovery opening 70 and are collected in the coarse particle container 71.

Figure 11:
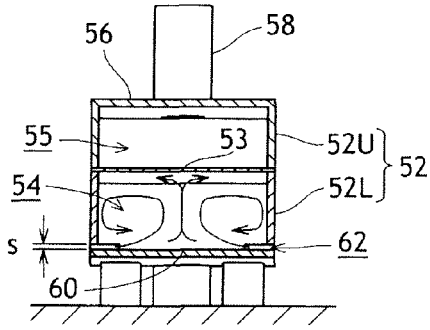
FIG. 11 is a cross-sectional view of the air sieving apparatus shown in FIG. 9 taken on the line XI-XI in FIG. 10.

Referring to FIG. 11, air sucked through the gaps 62 on the right and left sides flows inward in air currents along the upper surface of the bottom plate 60, and the air currents deflect upward in a middle part with respect to lateral directions and divide into rightward and leftward air currents flowing outward along the lower surface of the screen 53 in the lower space 54. As the rightward and leftward air currents approach the inside surfaces of the lower case 52L, the air currents deflect downward and merge into air currents flowing from a peripheral part toward the middle part along the upper surface of the bottom plate 60. Thus air flows in swirling air currents in the right and left parts of the lower space 54. Since suction acts on the air currents from the downstream side, it is conjectured that the swirling currents are forced to flow downstream by suction to produce spirally swirling air currents.

Therefore, the material fed into an upstream part of the lower space 54 is dispersed satisfactorily in the lower space 54 by the swirling air currents and the dispersed material is moved downstream by suction. Thus, the material will not be concentrated locally on a part of the screen 53, the entire part of the screen 53 serves for sieving and hence the meshes of the screen 53 are not easily clogged.

The continuous air sieving apparatus 50, similarly to that in the first embodiment, uses upward suction and downward gravity acting on particles and can use the effect of making inertial force produced by air currents for air sieving and gravity cancel each other to diminish the probability of the meshes of the screen 53 being clogged with particles. Even though particles are caught in the meshes of the screen, the particles are not firmly caught in the meshes.

As described above, currents of air sucked in through the gaps 62 extending along the bottom plate 60 flow in swirling air currents in the lower space 54 in the screening case. The swirling air currents divide into rightward and leftward air currents along the lower surface of the screen 53, and then flow outward along the lower surface of the screen 53. The swirling air currents and swirling particle currents entrained by the swirling air currents have a screen cleaning effect of scraping particles caught in the meshes of the screen off the screen. Since gravity acts continuously downward on particles caught in the meshes of the screen so as to separate particles from the screen and particles are not firmly caught in the meshes, particles caught in the meshes can be easily scraped off the screen to achieve a high cleaning effect.

Although the air sieving apparatus 50 is very simple in construction, the screen 53 is effectively cleaned at all times and the clogging of the screen 53 is substantially perfectly prevented. Therefore, the air sieving apparatus 50 can operate stably for a long time and can maintain high sieving accuracy in sieving fine particles in a particle size range below 50 μm.

The screening case 52 is tapped by the hammering devices 75 as the need arises to continue a stable operation for a long time. When the screening case 52 is thus tapped, particles caught in the meshes become easily removable, clogging of the meshes can be more effectively prevented, sieving accuracy can be still more improved, sieving speed is enhanced and work time can be reduced.

The screening case 52 of the air sieving apparatus 50 has the shape of a rectangular cylinder and hence can be formed in a longitudinally long shape. Thus, the air sieving apparatus 50 can be easily formed in a large structure to sieve a large quantity of powdered material continuously.

The air sieving method and the air sieving apparatus of the present invention may be used for the following three purposes.

(1) Obtaining fine particles as a product by removing coarse particles from a powdered material (2) Obtaining coarse particles as a product by removing fine particles from a powdered material (3) Recovering particles of intermediate particle sizes as a product by removing fine and coarse particles from a powdered material by doing (2) after (1) or by doing (1) after (2)

The air sieving method and the air sieving apparatus of the present invention are applicable to sieving powders of metals, inorganic substances and organic substances without regard to the quality of the powder by size into fine particles and coarse particles.

The air sieving method and the air sieving apparatus of the present invention are particularly suitable for uses for accurately sieving particles of particle sizes not larger than 50 μm, which could not have been achieved by the conventional sieving apparatus.

The air sieving method and the air sieving apparatus of the present invention are applicable to the fields of, for example, toners for copying machines and printers, fluorescent powders, powdered medicines, various kinds of ceramic powders, abrasive powders, metal powders, carbon powders, resin powders and various filler powders.

The invention claimed is:

1. An air sieving method comprising the steps of:

feeding a powdered material onto a single bottom plate disposed to cover a lower open end of a screening case, defining therein an internal space divided into an upper space and a lower space by a screen, with at least one gap formed in side parts of the screening case between a lower end surface of the screening case and the bottom plate;

generating ascending air currents in the upper space of the screening case by suction produced by a suction device;

generating currents of outside air entering the screening case through the at least one gap in the side parts of the screening case into the lower space by the ascending air currents in the upper space, wherein the screening case is configured so that the currents of outside air enter the screening case in a direction substantially parallel to the bottom plate;

causing the currents of outside air sucked into the lower space to flow between the bottom plate and the screen to produce swirling air currents in the lower space;

causing the powdered material fed onto the bottom plate to be carried and dispersed by the swirling air currents in the lower space; and causing the dispersed powered material to flow through the screen into the upper space to sieve the dispersed powdered material.

2. The air sieving method according to claim 1, wherein the swirling air currents include upward air currents extending to a lower surface of the sieving screen, air currents extending along the lower surface of the sieving screen, and downward air currents extending away from the sieving screen along an inner surface of the screening case.

3. An air sieving apparatus comprising:

a cylindrical screening case defining an internal space therein and provided with a screen dividing the internal space into an upper space and a lower space;

a single bottom plate disposed to cover a lower open end of the lower space of the cylindrical screening case, with at least one gap formed in a side part of the screening case between a lower end surface of the screening case and the bottom plate, wherein the screening case is configured so that air enter the screening case through said at least one gap travels in a direction substantially parallel to the bottom plate;

a material feed device having a material feed opening which opens into the lower space of the screening case, to feed a powdered material onto the bottom plate; and a suction device for generating ascending air currents in the upper space of the screening case in such a manner as to cause outside air to be sucked into the lower space through the gap, to flow over the bottom plate to induce currents and dispersion of the powdered material fed onto the bottom plate, and to cause air in which the powdered material is dispersed to be sucked upward through said screen.

4. The air sieving apparatus according to claim 3, further comprising:

a fine particle recovery device disposed between the screen and the suction device to recover fine particles being sucked by the suction device; and a coarse particle container protruding downward from a coarse particle recovery opening formed in the bottom plate.

5. The air sieving apparatus according to claim 4, wherein the lower space in the screening case is defined by a lower case having the shape of a circular cylinder, the upper space in the screening case is defined by an upper case having the shape of an upwardly tapered cone, the material feed device is formed in one of the lower case and the bottom plate, and the coarse particle recovery opening formed in the bottom plate is on a center axis of the cylindrical lower case.

6. The air sieving apparatus according to claim 4, wherein:

the screening case has the shape of a longitudinally elongate rectangular cylinder, the bottom plate has the shape of a longitudinally elongate rectangle, the bottom plate is disposed to cover the lower open end of the screening case with at said least one gap formed between the bottom plate and the lower open end of the screening case, an upper open end of the screening case is covered with a top plate having the shape of a longitudinally elongate rectangle, the material feed device is formed in one of a front wall of the longitudinally elongate lower case and a front end part of the bottom plate, the suction device sucks air in the screening case upward from a rear end part of the longitudinally elongate top plate, and the coarse particle recovery opening is formed in a rear end part of the longitudinally elongate bottom plate.

7. The air sieving apparatus according to claim 6, wherein the screening case and the bottom plate are declined rearward.

8. An air sieving method comprising the steps of:

feeding a powdered material onto a single bottom plate disposed to cover a lower open end of a screening case defining therein an internal space divided into an upper space and a lower space by a screen with at least one gap formed in side parts of the screening case between a lower end surface of the screening case and the bottom plate;

generating ascending air currents in the upper space of the screening case by suction produced by a suction device;

generating currents of outside air through the at least one gap in the side parts of the screening case into the lower space by the ascending air currents in the upper space;

causing the currents of outside air sucked into the lower space to flow between the bottom plate and the screen to produce swirling air currents in the lower space;

causing the powdered material fed onto the bottom plate to be carried and dispersed by the swirling air currents in the lower space; and causing the dispersed powdered material to flow through the screen into the upper space to sieve the dispersed powdered material;

wherein oppositely located gaps are provided in opposite side parts of the screening case and the currents of outside air sucked through the oppositely located gaps flow to merge with each other over the bottom plate.

9. An air sieving apparatus comprising:

a cylindrical screening case defining an internal space therein and provided with a screen dividing the internal space into an upper space and a lower space;

a single bottom plate disposed to cover a lower open end of the lower space of the cylindrical screening case with at least one gap formed in a side part of the screening case between a lower end surface of the screening case and the bottom plate;

a material feed device having a material feed opening which opens into the lower space of the screening case, to feed a powdered material onto the bottom plate; and a suction device for generating ascending air currents in the upper space of the screening case in such a manner as to cause outside air to be sucked into the lower space through the gap, to flow over the bottom plate to induce currents and dispersion of the powdered material fed onto the bottom plate, and to cause air in which the powdered material is dispersed to be sucked upward through said screen;

wherein oppositely located gaps are provided in opposite side parts of the screening case and said suction device is configured to cause the outside air sucked through the oppositely located gaps to merge with each other over the bottom plate.

* * * * *